United States Patent [19]

Iacono

[11] 4,138,060

[45] Feb. 6, 1979

[54] AUTOMATIC DRAFT CONTROL

[76] Inventor: Alfonso Iacono, 68 Lake St., Brooklyn, N.Y. 11223

[21] Appl. No.: 790,868

[22] Filed: Apr. 26, 1977

[51] Int. Cl.[2] ..... F23L 3/00

[52] U.S. Cl. ..... 236/1 G; 126/285 B; 251/138

[58] Field of Search ..... 236/1 G; 126/285 B; 431/20; 110/163; 251/138

[56] References Cited

U.S. PATENT DOCUMENTS

| | | | |
|---|---|---|---|
| 4,005,820 | 2/1977 | Cress | 236/1 G |
| 4,017,024 | 4/1977 | Grostick et al. | 236/1 G |
| 4,039,123 | 8/1977 | Frankel | 236/1 G |
| 4,046,318 | 9/1977 | Ripley | 236/1 G |

*Primary Examiner*—William E. Wayner

[57] ABSTRACT

A flue damper control includes a flue pipe, a damper in the flue pipe and an electro-mechanical control for opening and closing the damper according to thermostatically controlled conditions. The damper control is provided with an adjustment means to adjust the "full" open and "full" closed positions of the damper vane.

6 Claims, 6 Drawing Figures

AUTOMATIC DRAFT CONTROL

BACKGROUND OF THE INVENTION

This invention relates to a flue pipe control for heating systems which include a fuel-fired furnace where the rate of hot flue gases leaving the furnace are controlled according to the temperature of the flue gases, and more particularly, to a dampener control which can be adjusted to change the angle of the dampener in the "full" open and "full" closed positions.

DESCRIPTION OF THE PRIOR ART

Heating systems employing furnaces having fuel-fired burners require a vent stack to conduct combustion products away from the burner. Automatically controlled stack dampers are generally used in the ventiliation stacks to permit the stacks to be closed when the furnace is not operating to minimize heat loses when the furnace is not operating. However, for safe operation, it is necessary that the stack damper be open in advance of each operation of the burner and that the damper be maintained open for a short time following each operation of the burner to allow volatiles to be purged from the furnace following each operation. Accordingly, systems in which automatic dampers are used generally include a control arrangement which provides an interlock between the damper control mechanism and fuel supply apparatus of the system to assure that the damper is fully open before the burner operates and is maintained open for a short time after the completion of the operation of the burner.

One such arrangement is disclosed in the U.S. Pat. No. 3,010,451 to Hodgins in which a primary burner control is conditional on and subsequent to the opening of the damper. A damper drive motor is energized in response to a call for heat to drive the damper to an open position. A normally open microswitch, which is connected in series with the burner circuit when the damper reaches the fully open position. At the end of the run, the damper drive motor is deenergized, and a bias spring permits the microswitch to open, interrupting the burner circuit. A time lag is provided between the interruption of the burner circuit and the closing of the damper to allow volatiles to be purged from the furnace following operation of the burner.

Another damper control system is disclosed in the U.S. Pat. No. 4,017,024 to Hodgins in which an automatic damper control for use in a heating system where the damper is opened and closed by a reversible motor and thermostatically responsive switches.

U.S. Pat. No. 4,039,123 to Frankel discloses a damper control where the vane is maintained in a closed position when the heating system is not being used, but is in an open position during the heating cycle. The vane is closed by an electric motor against the force of a torsion return spring.

In assembling dampers with automatic controls, it is often necessary to adjust the "full" open and "full" closed positions of the damper vane. Occasionally, the damper vane will also slip out of adjustment during continuous use which requires adjustment. The prior art devices have not provided for damper vane adjustment. It is therefore the object of this invention to provide a damper control that is adjustable to properly adjust the "full" open and "full" closed positions of the damper vane.

DESCRIPTION OF THE PREFERRED EMBODIMENT

Figure 1:
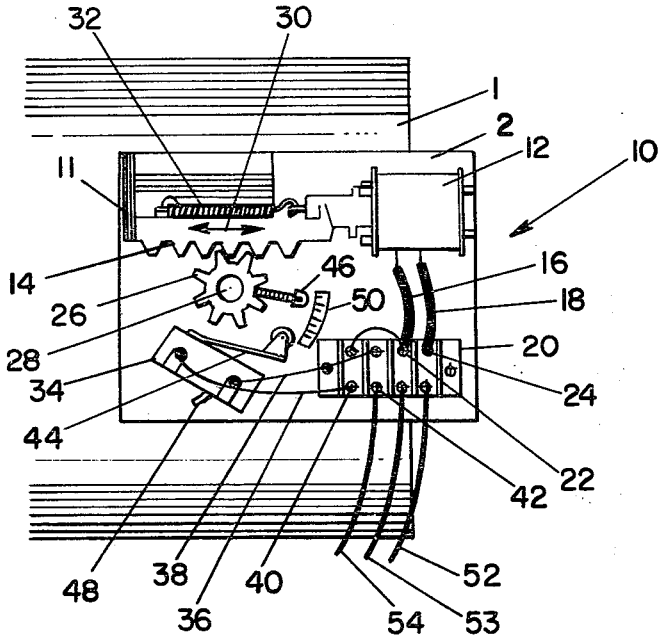
FIG. 1 is a top plan view of the damper control system of this invention.

Referring to the drawings and in particular FIG. 1, there is shown a flue pipe 1 and a damper control 10 mounted in a housing 2, with the cover removed. The damper control 10 includes a solenoid 12 having a toothed rack 14. The solenoid 12 is electrically connected by wires 16 and 18 to an electrical terminal 20 at connections 22 and 24. The toothed rack 14 engages a pinion gear 26 which is fixed to the end of shaft 28. When the solenoid 12 is activated, the toothed rack 14 reciprocates in the direction of the arrows 30 causing the pinion gear 26 to rotate shaft 28. The toothed rack 14 moves against the force of return spring 32 which urges the toothed rack away from the solenoid 12. There is a microswitch 34 with electrical wires 36 and 38 connected to the terminal 20 at posts 40 and 42. The microswitch 34 has a trip lever 44 which is tripped by lever arm 46 mounted on shaft 28 when the pinion gear 26 is moved by toothed rack 14. the microswitch 34 is mounted to housing 2 in a slot 48 which allows the switch to be adjusted to perform the switching function at a predetermined time cycle of the heating or cooling of the furnace. A gage 50 is provided to assist in the proper adjustment of the microswitch. Connected to the terminal 20 and thermostat electrical wires 52 and 53 and a furnace burner wire 54. The operation of the damper control system will be discussed in more detail later.

Figure 2:
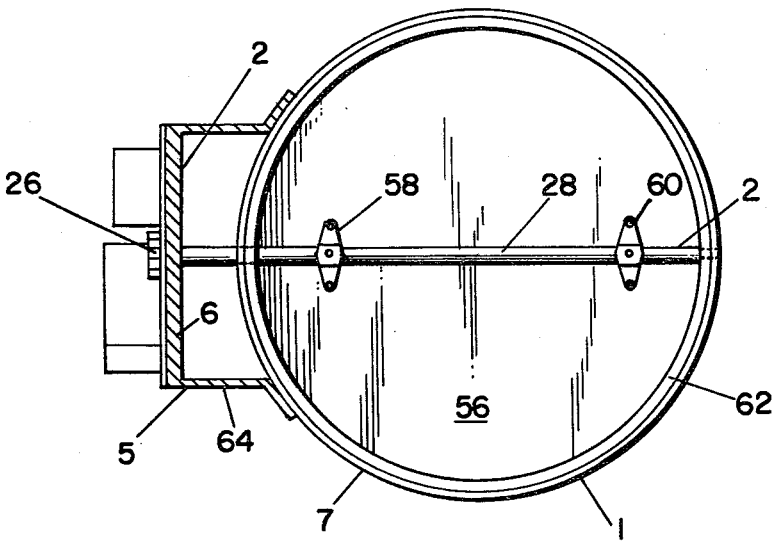
FIG. 2 is an end view of a flue damper vane and damper control system of this invention.
Figure 3:
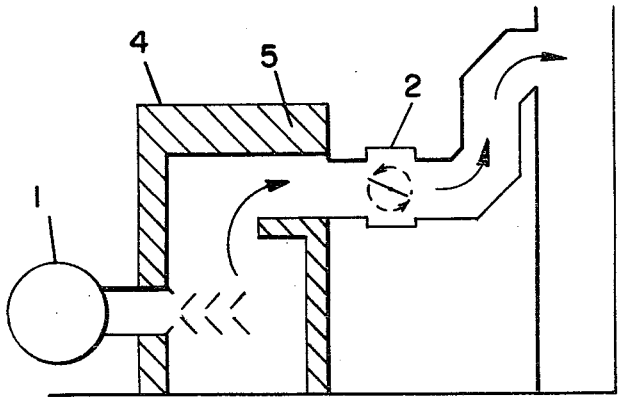
FIG. 3 is a schematic of a fuel fired furnace showing hot flue gases flow controlled by the damper control system of this invention.

A damper vane 56 and the damper control 10 are shown in FIG. 2. The damper vane 56 is mounted on shaft 28 by connections 58 and 60. The shaft 28 is pivotally mounted in the flue pipe 1 with one end extending through the wall of the pipe. Pinion gear 26 is shown mounted to the end of the shaft 28 extending through the wall. The flue pipe 1 is insulated with asbestos 62 to protect the electrical components of the damper control system 10. To further protect the damper control system 10, the housing 2 is constructed with a stand 64 to remove the controls from direct contact with the flue pipe 1.

Figure 5:
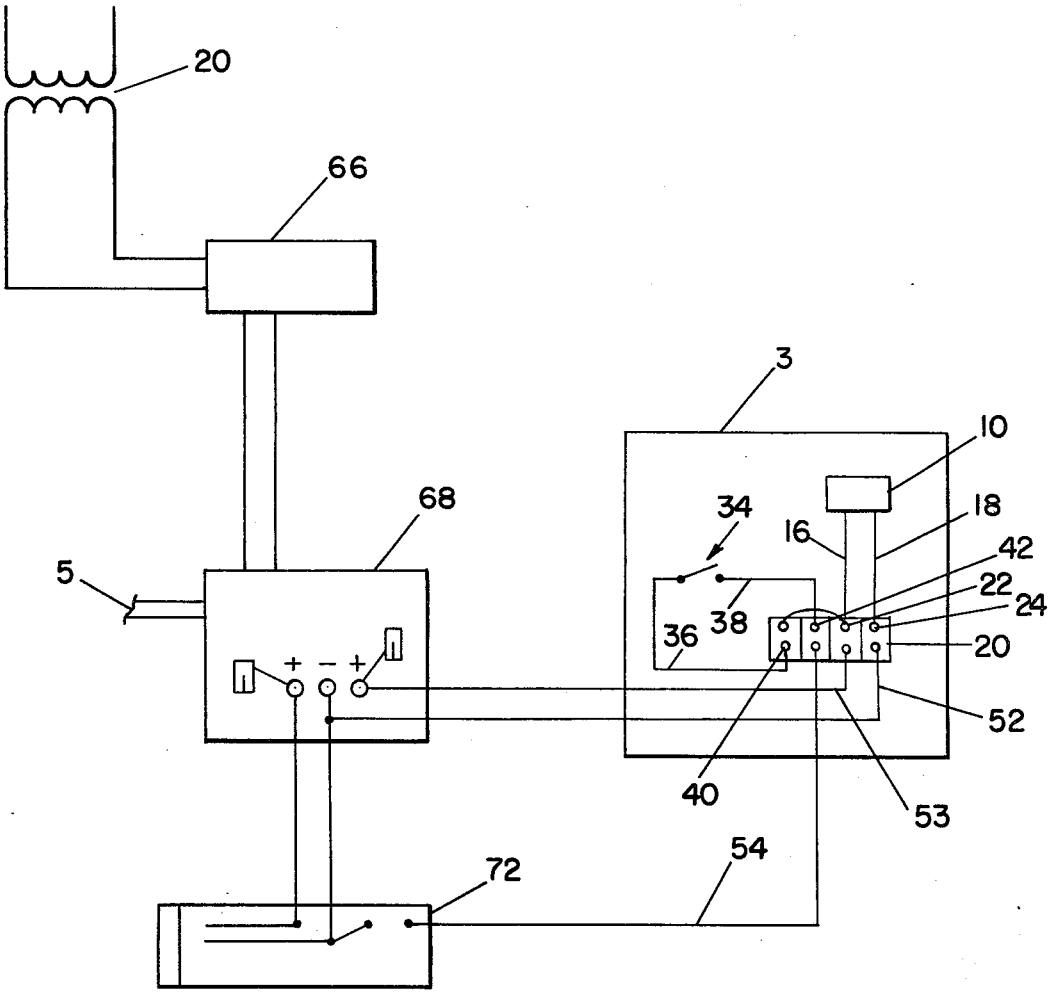
FIG. 5 is an electrical circuit diagram showing typical circuitry for the installation of the damper vent control system of the invention in connection with a fuel fired furnace control.
Figure 6:
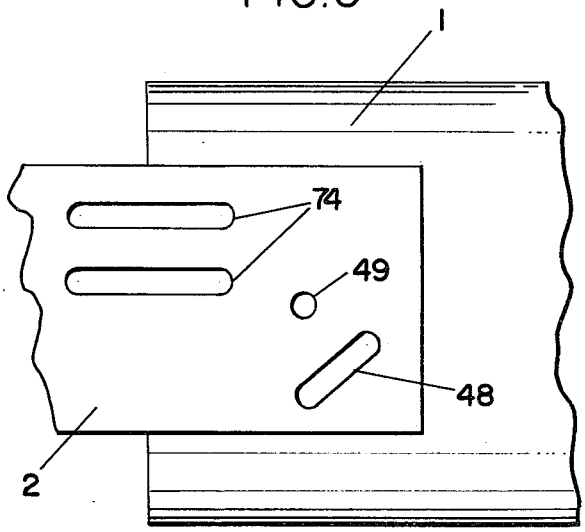
FIG. 6 is a rear view, partially broken away, of the device shown in FIG. 1.

FIG. 5 shows the electrical diagram where a thermostat 66 is connected to a heat relay 68 and to a transformer 20. The heat relay 68 is connected to the fuel furnace oil burner electrical circuit control switch 72 and to the terminal strip 20, solenoid 10 and microswitch 34.

The operation of the damper control system begins with a demand signal from the thermostat 66 to the heat relay 68. The heat relay 68 activates the control solenoid 10 which closes microswitch 34 by rotating lever arm 46 tripping lever 44. When the microswitch 34 is closed, an electrical current is sent to burner switch 72 energizing the burner controls.

When the solenoid 12 is energized, it moves toothed rack 14 against the force of return spring 32 which rotates pinion gear 26 fixed to shaft 28, thereby rotating damper vane 56 in the flue pipe 1.

Figure 4:
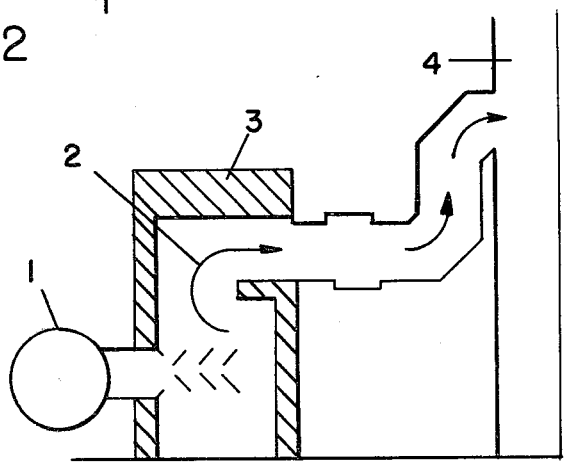
FIG. 4 is a schematic of a fuel fired furnace showing hot flue gases which are not controlled.

The position of the damper vane 56 can be adjusted to desired "full" open and "full" closed positions by loosening the microswitch 34 and moving it in slot 48, while at the same time, loosening and moving solenoid 12 in slot 74, shown in FIG. 4, and tightening the microswitch 34 in an open sequence when lever 46 is in an open position. The microswitch 46 and solenoid 12 must be adjusted at the same time, otherwise, the microswitch will not activate or deactivate the burner control circuit at the instance the damper vane 56 is opened or closed. The microswitch 34 also acts as a safety device if there is a malfunction of the damper vane 56 or the solenoid 12 since the return spring will urge the toothed rack 14 away from the solenoid 12 which is the closed position for the damper vane. Moving the toothed rack 14 away from the solenoid 12 also breaks the circuit from the microswitch 34 to the burner control circuit.

Although only one specific form of the invention has been described and illustrated in the drawings, it will be understood that various modifications and changes may be made by those skilled in the art without departing from the inventive concept. Reference should therefore be had to the appended claims for a definition of the scope of the invention.

What is claimed is:

1. A furnace flue gases control device for regulating the damper vane in a flue pipe comprising;

a flue pipe section having a damper vane therein;

a shaft for rotating said damper vane, said shaft extending at least through one side of said flue pipe section;

a pinion gear affixed to the shaft end extending through said side of said flue pipe section;

a toothed rack engaging said pinion for rotating said damper vane to an open position;

a solenoid for reciprocating said toothed gear rack;

a return spring for returning said damper vane to a closed position;

a switch means for controlling a furnace burner circuit; and a lever on said pinion gear for switching said switch means, wherein said solenoid and said switch are adjustable to change the open and closed positions of said damper vane.

2. A furnace flue gases control device as claimed in claim 1, wherein said solenoid and said switch mounted in slots for adjustment.

3. A furnace flue gas control device as claimed in claim 2, wherein said switch is a microswitch.

4. Preamble claim 3, wherein said damper control device is mounted in a housing.

5. Preamble claim 4, wherein said flue pipe section is lined with asbestos.

6. Preamble claim 5, wherein said solenoid is electrically connected to a thermostat for controlling the heating and cooling of a furnace.

* * * * *